US007188932B2

(12) United States Patent
Sano et al.

(10) Patent No.: US 7,188,932 B2
(45) Date of Patent: Mar. 13, 2007

(54) ELECTROSTATIC ACTUATOR, DROPLET EJECTION HEAD AND DROPLET EJECTION DEVICE

(75) Inventors: Akira Sano, Suwa (JP); Masahiro Fujii, Suwa (JP)

(73) Assignee: Seiko Epson Corporation (JP)

( * ) Notice: Subject to any disclaimer, the term of this patent is extended or adjusted under 35 U.S.C. 154(b) by 259 days.

(21) Appl. No.: 11/013,102

(22) Filed: Dec. 15, 2004

(65) Prior Publication Data

US 2005/0134653 A1 Jun. 23, 2005

(30) Foreign Application Priority Data

Dec. 17, 2003 (JP) ..... 2003-418865

(51) Int. Cl.
*B41J 2/04* (2006.01)

(52) U.S. Cl. ..... 347/54; 347/68

(58) Field of Classification Search ..... 347/20, 347/54, 56, 61, 63–65, 67–68, 70
See application file for complete search history.

(56) References Cited

U.S. PATENT DOCUMENTS 6,224,191 B1 * 5/2001 Saito et al. ..... 347/64

FOREIGN PATENT DOCUMENTS

JP 09-039235 2/1997
JP 10-286952 10/1998
JP 2000-355103 12/2000
JP 2003-300326 10/2003

OTHER PUBLICATIONS

Communication from Japanese Patent Office regarding related application.
Patent Abstract of Japanese Patent Document No. 11-165412.
Communication from European Patent Office regarding counterpart application.
Communication from Japanese Patent Office re: related application.
Patent Abstracts of Japan No. 2000052548.
Patent Abstracts of Japan No. 11165412.
Patent Abstracts of Japan No. 10286952.
Communication from European Patent Office re: counterpart application.

* cited by examiner

*Primary Examiner*—Juanita D. Stephens
(74) *Attorney, Agent, or Firm*—Harness, Dickey & Pierce, P.L.C.

(57) ABSTRACT

An electrostatic actuator is provided which can increase the amount of displacement of a diaphragm, thereby improving the ejection pressure when employed as a drive mechanism in a droplet ejection head. The electrostatic actuator comprises: a first substrate having a diaphragm functioning as a first electrode; and a second substrate coupled to the first substrate and having a second electrode opposite the first electrode, wherein: the diaphragm is displaced with an electrostatic force generated by applying a voltage between the electrodes; and an insulation film is provided on a coupling surface of the first substrate which couples with the second substrate, and an area of the insulation film corresponding to the diaphragm has a reduced thickness region.

11 Claims, 6 Drawing Sheets

ELECTROSTATIC ACTUATOR, DROPLET EJECTION HEAD AND DROPLET EJECTION DEVICE

RELATED APPLICATIONS

This application claims priority to Japanese Patent Application No. 2003-418865 filed Dec. 17, 2003 which is hereby expressly incorporated by reference herein in its entirety.

BACKGROUND

1. Field of the Invention

The present invention relates to an electrostatic actuator used as a drive mechanism of an inkjet head or the like, a droplet ejection head having the electrostatic actuator, and a droplet ejection device having the droplet ejection head.

2. Related Art

Generally, a droplet ejection head with an electrostatic actuator has a pressure-generating chamber for ejecting droplets by applying pressure. By giving an elastic displacement to part of the pressure-generating chamber (a diaphragm) using an electrostatic force, a pressure for ejecting droplets from an opening of a nozzle is generated.

In recent years, inkjet heads (which are a typical example of the above type of droplet ejection head) have been employing an increasing number of nozzles to accommodate fast-speed printing. In addition, in response to a demand for higher resolutions, drive mechanisms (actuators) of very small sizes have been required. As described above, as the drive mechanism becomes smaller and denser, the area of the diaphragm of each pressure-generating chamber becomes smaller, and therefore the developed pressure in the pressure-generating chamber caused by the displacement of the diaphragm also becomes smaller, which further reduces the energy given to droplets to be ejected. In this case, securing stability in droplet-landing becomes difficult because the mass of dispensed ink is reduced, accompanied by the reduction of the dispensing speed. Therefore, it has been requested to increase the developed pressure in the pressure chamber by increasing the amount of displacement of the diaphragm.

Further, as an inkjet recording head aiming to secure the traveling speed of ink droplets and to control the displacement of the diaphragm, there is a technique, regarding a substrate placed opposite the substrate having the diaphragm, to make a two-tiered concavity, which is provided to configure a vibration chamber for the diaphragm, by scraping in two levels forming a shallow concavity and a deep concavity, wherein an electrode is provided for each concavity (refer to Japanese Unexamined Patent Publication No. 10-286952, for example).

According to the above technique, due to the configuration having a deep concavity as well as a shallow concavity, a larger displacement of the diaphragm can be secured compared to a technique which employs only a shallow concavity. Therefore, such a configuration is expected to contribute to the improvement of developed pressure inside the pressure chamber.

However, like the technique in Japanese Unexamined Patent Publication No. 10-286952, forming a plurality of concavities with different depths on an oppositely placed substrate requires a plurality of photoresist pattern alignment processes. In such photoresist pattern alignment, a small amount of error occurs in the actual process. Therefore, a configuration having a plurality of concavities requires a dimensional component design where a potential error occurring in each concavity formation step is taken into consideration, which leads to a result contradicting the concept of smaller size and higher density drive mechanisms.

The present invention has been developed in consideration of such a problem and is intended to provide a simply-manufacturable electrostatic actuator that can increase the displacement amount of the diaphragm and can therefore improve ejection pressure when used as a drive mechanism of a droplet ejection head. In addition, the present invention aims to provide a droplet ejection head and a droplet ejection device having such an electrostatic actuator.

SUMMARY

The electrostatic actuator according to the present invention comprises a first substrate having a diaphragm functioning as a first electrode, and a second substrate coupled to the first substrate and having a second electrode placed opposite the first electrode, wherein the diaphragm is displaced using an electrostatic force generated by applying a voltage between the electrodes. Further, in the first substrate, an insulation film is provided on the coupling surface of the first substrate which couples with the second substrate, and an area of the insulation film corresponding to the diaphragm has a thin film-thickness region (a reduced thickness region). With such a configuration, the amount of displacement of the diaphragm can be increased. Therefore, if a droplet ejection head is configured with the above electrostatic actuator, the developed pressure inside the pressure-generating chamber, which generates pressure using the displacement of the diaphragm, can be increased, and thus a configuration of a droplet ejection head having stabilized dispensing characteristics can be achieved. In addition, since the thin film-thickness region can be formed at any part within the region corresponding to the diaphragm, a small amount of error caused in the manufacturing process is allowable, which relaxes the requirements for fabrication accuracy and leads to easier manufacturing.

Further, in the electrostatic actuator according to the present invention, the thin film-thickness region is provided at the approximate widthwise center of the region corresponding to the diaphragm. With such a configuration, the thin film-thickness region is surely placed within the region opposite to the second electrode which prevents the diaphragm from not functioning to increase the amount of displacement when shifted widthwise from the region placed opposite to the second electrode.

Furthermore, in the electrostatic actuator according to the present invention, the thin film-thickness region is provided at the approximate lengthwise center of the region corresponding to the diaphragm. With such a configuration, the diaphragm can be displaced uniformly. Therefore, if such an electrostatic actuator is employed in a droplet ejection head, a droplet ejection head with a configuration which can uniformly increase the developed pressure inside the entire pressure-generating chamber that generates pressure by displacing the diaphragm is achieved.

In addition, the insulation film of the electrostatic actuator according to the present invention is formed of a $SiO_2$ film or a SiN film. Thus, a $SiO_2$ film or SiN film can be employed as an insulation film. Since a SiN film has a higher dielectric breakdown voltage compared to a $SiO_2$ film, it is preferable to use a SiN film.

The droplet ejection head according to the present invention comprises the first substrate having a diaphragm functioning as the first electrode, and the second substrate, having the second electrode placed opposite to the first electrode, coupled to the first substrate, wherein the diaphragm is displaced using an electrostatic force generated by applying a voltage between the electrodes, which makes droplets ejected from a nozzle communicating to a pressure-generating chamber which generates a pressure for ejecting droplets. Further, in the first substrate, an insulation film is provided on the coupling surface with the second substrate, and a region of the insulation film corresponding to the diaphragm has a thin film-thickness region. With such a configuration, the amount of displacement of the diaphragm can be increased and the developed pressure inside the pressure-generating chamber can be increased. Thus, a configuration of a droplet ejection head having stabilized ejection characteristics is achieved. In addition, since the thin film-thickness region can be formed at any part within the region corresponding to the diaphragm, a small amount of error caused in the manufacturing process is allowable, which relaxes the requirements for fabrication accuracy and leads to easier manufacturing.

Further, in the droplet ejection head according to the present invention, the thin film-thickness region is provided at the approximate widthwise center of the region corresponding to the diaphragm. With such a configuration, the thin film-thickness region is surely placed within the region opposite to the second electrode, which prevents the diaphragm from not functioning to increase the amount of displacement when shifted widthwise from the region placed opposite to the second electrode.

Furthermore, in the droplet ejection head according to the present invention, the thin film-thickness region is provided at the approximate lengthwise center of the region corresponding to the diaphragm. With such a configuration, the diaphragm can be displaced uniformly and the developed pressure inside the entire pressure-generating chamber can be increased uniformly.

Also, in the droplet ejection head according to the present invention, the thin film-thickness region is provided at a position closer to the nozzle than the approximate lengthwise center of the region corresponding to the diaphragm. With such a configuration, the pressure, in the pressure-generating chamber, generated near the nozzle can be increased, and therefore the droplet ejection speed can be accelerated.

In the droplet ejection head according to the present invention, the thin film-thickness region is provided at a position farther from the nozzle than the approximate lengthwise center of the region corresponding to the diaphragm.

With such a configuration, the developed pressure on the side opposite to the nozzle in the pressure-generating chamber, that is, the developed pressure on the reservoir side according to the embodiment described later can be increased, and more fluid can be drawn into the pressure-generating chamber from the reservoir.

In addition, in the droplet ejection head according to the present invention, the insulation film is formed of a $SiO_2$ film or a SiN film. Thus, a $SiO_2$ film or SiN film can be employed as an insulation film. Since a SiN film has a higher dielectric breakdown voltage compared to a $SiO_2$ film, it is preferable to use a SiN film.

Moreover, a droplet ejection device according to the present invention has any of the foregoing droplet ejection heads. As described above, because of a droplet ejection head with a high developed pressure in the pressure-generating chamber and stabilized ejection characteristics, a droplet ejection device which achieves stabilized high-quality printing can be obtained.

DETAILED DESCRIPTION

First Embodiment

Figure 1:
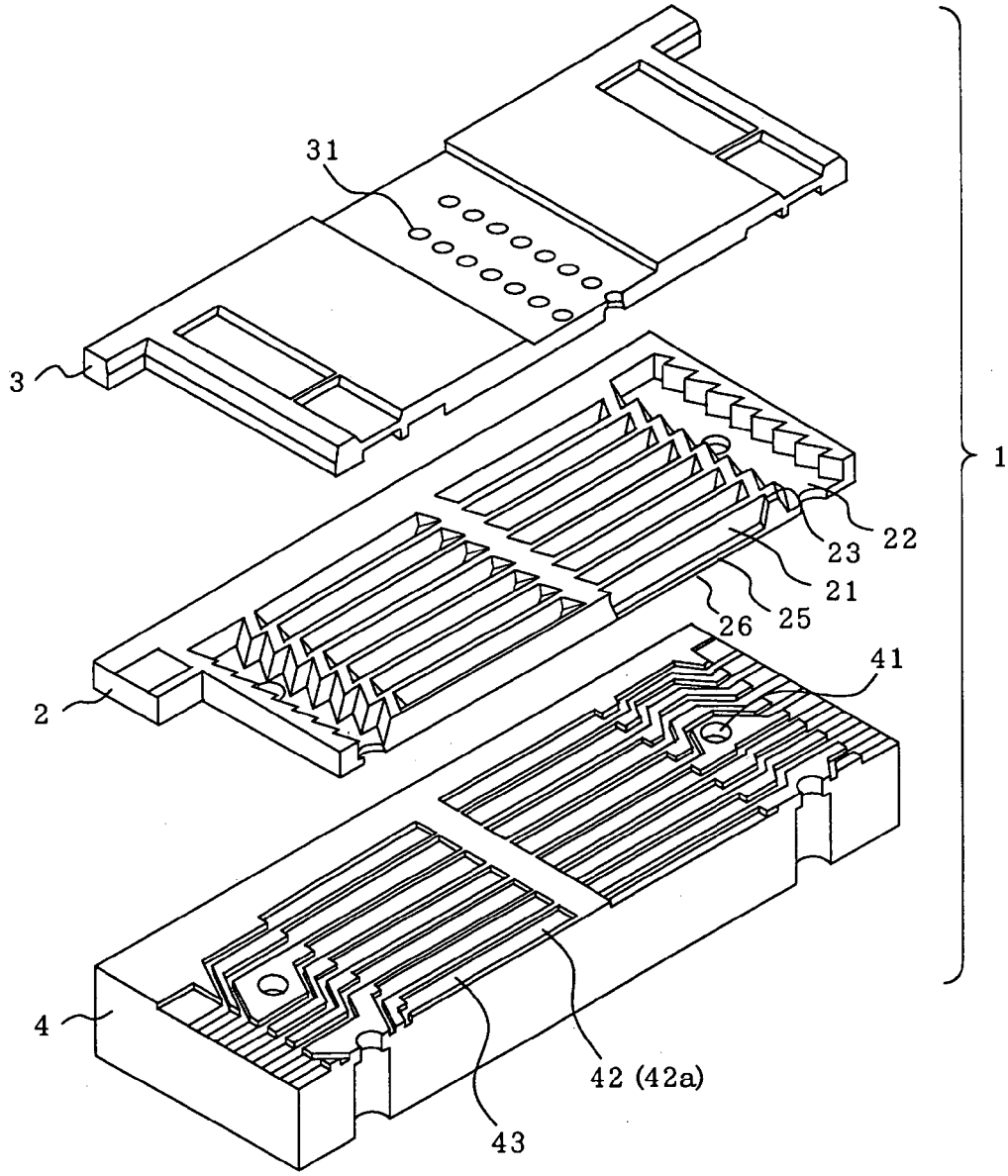
FIG. 1 is an exploded perspective view of a droplet ejection head having an electrostatic actuator according to the first embodiment.

FIG. 1 is an exploded perspective view of a droplet ejection head having an electrostatic actuator according to a first embodiment of the present invention.

As shown in the figure, a droplet ejection head 1 has a silicon substrate 2 functioning as the first substrate, which is sandwiched by a silicon nozzle plate 3 on the upper side and a borosilicate glass substrate 4, having a coefficient of thermal expansion close to that of silicon and functioning as the second substrate, on the lower side, forming a three-layer configuration. On the surface of the silicon substrate 2 in the middle, grooves are etched. The grooves respectively function as an independent pressure-generating chamber 21, a reservoir 22, and an orifice 23 communicating the reservoir 22 through to each pressure-generating chamber 21. By covering these grooves with the nozzle plate 3, the parts 21, 22 and 23 are divided.

On the nozzle plate 3, a nozzle 31 is formed at a position corresponding to the tip of each pressure-generating chamber 21. Each nozzle 31 communicates to each pressure-generating chamber 21. Further, at a position on the glass substrate 4 where the reservoir 22 is located, a fluid supply port 41, which communicates to the reservoir 22, is formed.

The fluid to be ejected is supplied from an external tank, which is not illustrated, through the fluid supply port 41 into the reservoir 22. The fluid supplied to the reservoir 22 is further supplied through each orifice 23 into each independent pressure-generating chamber 21.

Figure 2:
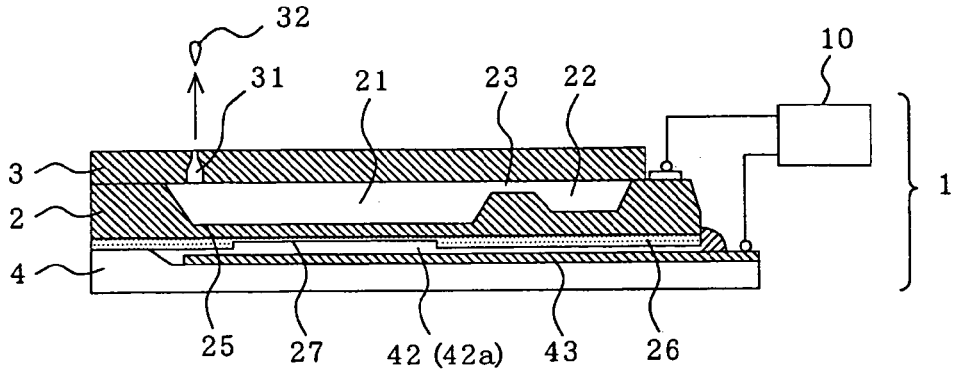
FIG. 2 is a cross-sectional view of the droplet ejection head in FIG. 1.

A sole 25 of each independent pressure-generating chamber 21 is thin-walled and functions as a diaphragm 25 which can make an elastic displacement in the outward direction with reference to its surface, that is, in the vertical direction in FIG. 2.

Therefore, the sole 25 may be called the diaphragm 25, as a matter of convenience of later description.

Here, the diaphragm 25 functions as a common electrode (the first electrode). Further, on the surface of the glass substrate 4, placed opposite to each diaphragm 25, a concavity 42 is formed, which configures a hermetically-sealed vibration chamber 42*a*. On the bottom surface of the vibration chamber 42*a*, an individual electrode (the second electrode) 43 made of, for example as a transparent electrode, an indium tin oxide (ITO) film is formed opposite to the diaphragm 25.

Although not illustrated in detail in FIG. 1, on the silicon substrate 2 of the first embodiment, an insulation film 26 is formed on the coupling surface which couples with the glass substrate 4. In addition, the insulation film 26, which is formed on the entire surface of the silicon substrate 2 in the present embodiment, can be formed only on the region opposite to the individual electrode 43.

Here, the insulation film 26 is different from conventional films as a feature for preventing a short circuit occurring when the diaphragm 25 contacts the individual electrode 43 and a breakage of the individual electrode 43 and the diaphragm 25. The first embodiment attempts to improve the developed pressure inside the pressure-generating chamber 21 by contriving the shape of the insulation film 26. The shape of the insulation film 26 will now be described in detail.

Figure 3:
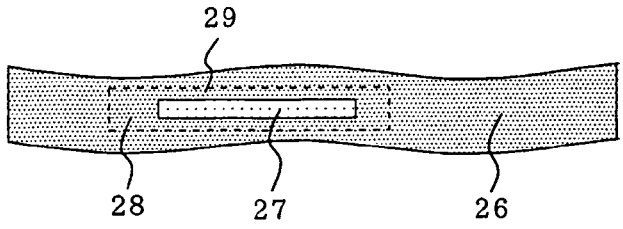
FIG. 3 is a drawing of an insulation film formed on the silicon substrate in FIG. 2 viewed from the vibration-chamber side.

FIG. 2 is a cross-sectional drawing of the droplet ejection head in FIG. 1. FIG. 3 is a drawing of the insulation film formed on the silicon substrate in FIG. 2 viewed from the vibration-chamber side. In addition, in the insulation film in FIG. 3, a region corresponding to the diaphragm 25 (hereinafter referred to as a diaphragm region 29) is shown by a dotted line. Referring to these figures, features of the present invention will now be described in detail.

The insulation film 26 has a thin film-thickness region 27 (reduced thickness region) in the approximate center, in the present embodiment, of the diaphragm region 29. In addition, in FIG. 2, a region with a thick film-thickness in the diaphragm region 29 is indicated by reference number 28. The form of the thin film-thickness region 27 is a rectangle in FIG. 2, which is only an example and the shape is not limited to a rectangle. Further, the size of the thin film-thickness region 27 is preferred to be relatively large for the following reason. However, the size must be within the diaphragm region 29.

The insulation film 26 is formed of, specifically, an oxide film ($SiO_2$) or nitride film (SiN). The $SiO_2$ film can be formed rather easily and stably by means of thermal oxidation at a relatively low temperature of approximately 900 degrees centigrade. On the other hand, a SiN film can be formed by heating silicon in a nitrogen atmosphere.

In the insulation film 26, the film thickness of the thin film-thickness region 27 is set thick enough to tolerate the voltage applied and determined in accordance with the dielectric breakdown voltage which is determined depending on the material of the insulation film 26. The thickness of the thin film-thickness region 27 is preferably as thin as possible for the following reason. However, since SiN has a higher dielectric breakdown voltage compared to $SiO_2$, the film thickness of the thin film-thickness region 27 can be made much thinner by using SiN. Therefore, it is preferable to use a SiN film. Further, in the insulation film 26, the thickness of the thick film-thickness region 28 is preferably uniform and thick. With such a form, a high dielectric breakdown voltage of the entire silicon substrate 2 and the air-tightness of the vibration chamber 42*a* can be secured. In the present embodiment, the insulation film 26 is configured by a SiN film. Further, the thickness of the thick film-thickness region 28 is approximately 100 nm, and the thickness of the thin film-thickness region 27 is approximately 60 nm. In addition, reference number 10 in FIG. 2 denotes a drive circuit coupled to the silicon substrate 2 and the individual electrode 43.

Figure 4:
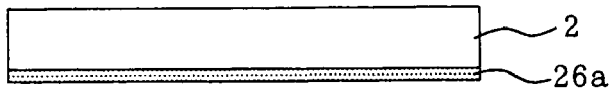
FIGS. 4A–F are drawings of a formation process of the insulation film formed on the silicon substrate in FIG. 2.
Figure 4:
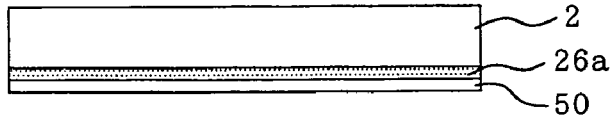
Figure 4:
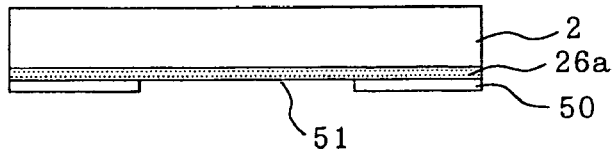
Figure 4:
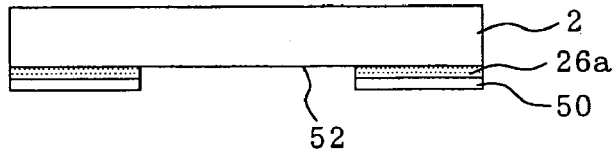
Figure 4:
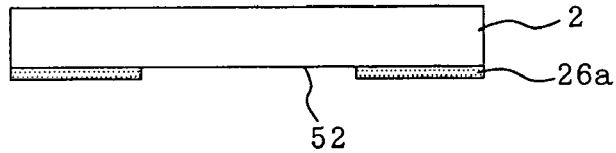
Figure 4:
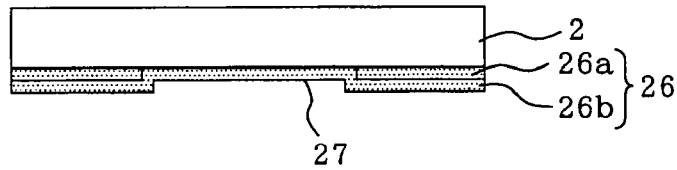

Next, the formation process of the insulation film 26 formed on the silicon substrate 2 will be described referring to the process drawings of FIG. 4. In addition, for the formation process of the other parts, the conventionally known procedure may be employed and a description thereof is omitted.

In FIG. 4A, an insulation film 26*a* is formed on the back surface of the silicon substrate 2 using a CVD device;

in FIG. 4B, a photoresist film 50 is formed on the insulation film 26*a;* in FIG. 4C, the photoresist film 50 is exposed to remove the photoresist film corresponding to a region 51 forming the thin film-thickness region 27 of the insulation film 26*a;* in FIG. 4D, a hole 52 is formed on the insulation film 26*a* by etching the insulation film 26*a* by using the photoresist film 50 remaining on the insulation film 26*a* as an etching mask;

in FIG. 4E, the photoresist film 50 is removed; and in FIG. 4F, on the insulation film 26*a* having the hole 52, an insulation film 26*b* is formed again by the CVD device.

In the above procedure, the insulation film 26 having the partially thin film-thickness region 27 can be formed on the silicon substrate 2.

Next, the operation of the droplet ejection head 1 having the silicon substrate 2 covered with the insulation film 26 formed in the above procedure will be described referring to FIG. 2.

By applying a voltage to the individual electrode 43 using the drive circuit 10, an electrostatic attraction force is generated between the diaphragm 25 and the individual electrode 43. Then, the diaphragm 25 is pulled by the individual electrode 43 so as to be warped (curved) downward, increasing the capacity of the pressure-generating chamber 21. Thus, the fluid to be ejected is refilled from the reservoir 22 through the orifice 23 into the pressure-generating chamber 21. Next, by stopping the application of voltage to the individual electrode 43, the electrostatic attraction force disappears and the diaphragm 25 reverts (returns) to its original shape, rapidly reducing the capacity of the pressure-generating chamber 21, which rapidly increases the pressure inside the pressure-generating chamber 21 and part of the fluid filled in the pressure-generating chamber 21 is ejected as a droplet 32 through the nozzle 31 communicating with the pressure-generating chamber 21.

Here, since the droplet ejection head 1 of the present embodiment has the thin film-thickness region 27 on the insulation film 26, it is possible to increase the displacement of the diaphragm 25 by the amount of a space A formed by the region 27 (refer to FIG. 5 described later), as compared to the case of the insulation film 26 formed, with a uniform thickness, by the thick film-thickness region 28 without making the region 27. Therefore, it is possible to increase the developed pressure inside the pressure-generating chamber 21. Details will now be described in detail referring to FIG. 5.

Figure 5:
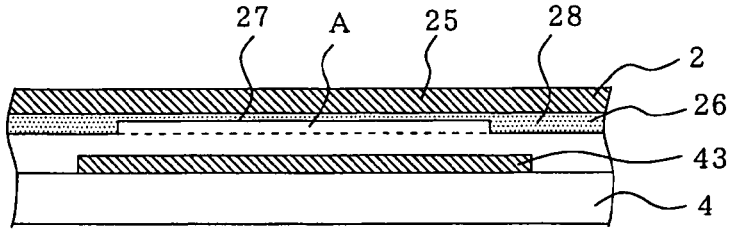
FIGS. 5A–D are drawings of the displacement behavior of a diaphragm (Part 1).
Figure 5:
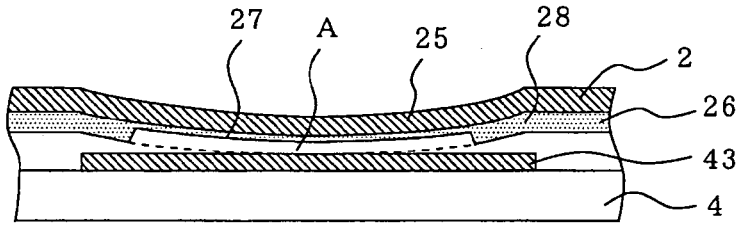
Figure 5:
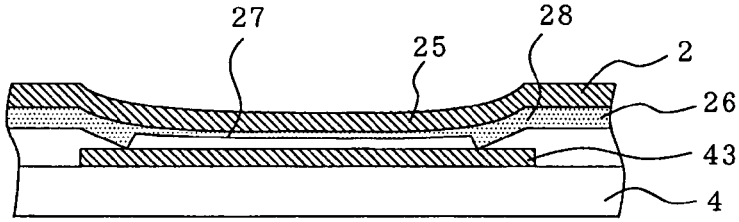
Figure 5:
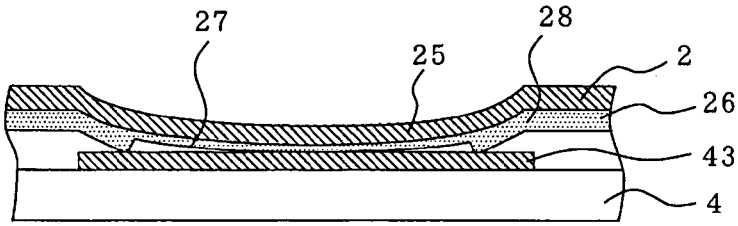
Figure 6:
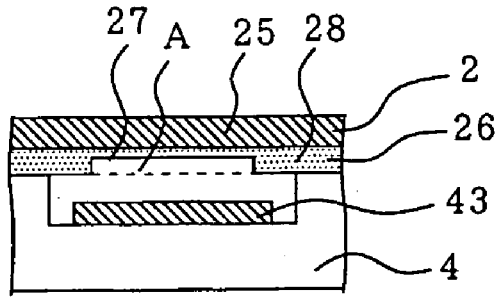
FIGS. 6A–D are drawings of the displacement behavior of a diaphragm (Part 2).
Figure 6:
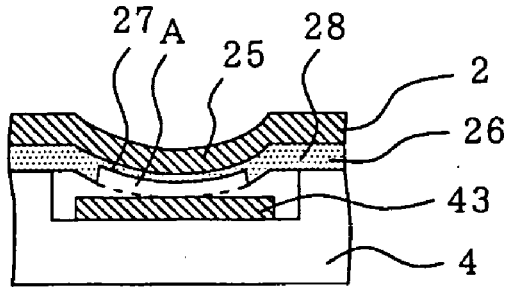
Figure 6:
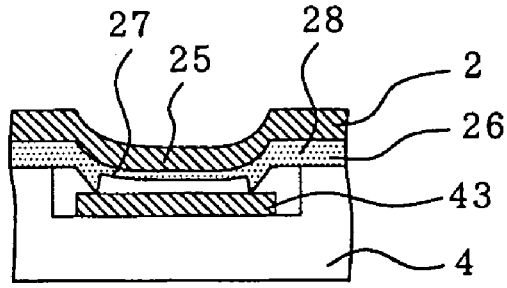
Figure 6:
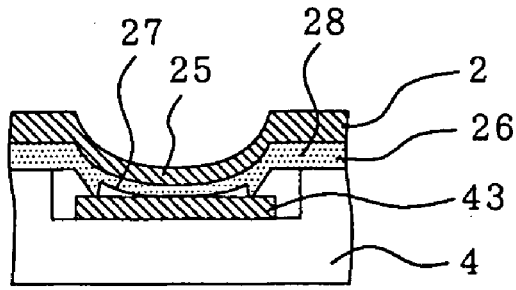

FIG. 5 and FIG. 6 are drawings of a displacement behavior of a diaphragm. FIG. 5 is an enlarged cross-sectional view of the relevant part in FIG. 2. FIG. 6 is an enlarged view of the relevant part in FIG. 2 that is sectioned by a plane perpendicular to the plane of FIG. 2.

The diaphragm 25 before displacement shown in FIG. 5A and FIG. 6A is warped downward by the electrostatic attraction force generated between the diaphragm 25 and the individual electrode 43. Here, if the thin film-thickness region 27 is not provided on the insulation film 26, the diaphragm 25 can not be warped more than the extent shown in FIG. 5B and FIG. 6B. On the other hand, in the present embodiment, since the thin film-thickness region 27 is provided, the diaphragm 25 can be warped more by the amount of the space A formed by the region 27. That is, as shown in FIG. 5C and FIG. 6C, the boundary between the thick film-thickness region 28 and the thin film-thickness region 27 first contacts with the individual electrode 43. With the enhanced warpage as shown in FIG. 5D and FIG. 6D, the thin film-thickness region 27 contacts with the individual electrode 43.

As described above, since the displacement of the diaphragm 25 can be increased by providing the thin film-thickness region 27 on the insulation film 26, the developed pressure inside the pressure-generating chamber 21 can be increased.

Now, the increase of developed pressure inside the pressure-generating chamber 21 caused by providing the thin film-thickness region 27 on the insulation film 26 will be described from the viewpoint of the electrostatic force generated between the diaphragm 25 and the individual electrode 43. Here, the following equation (1) expresses the electrostatic force generated between the diaphragm 25 and the individual electrode 43.

$$F=\tfrac{1}{2}\cdot\epsilon 0\cdot\{E/(g+h/\epsilon 1)\}^2\cdot S \quad (1)$$

where:

$\epsilon 0$: permittivity in vacuum; E: voltage; g: distance between insulation film and individual electrode (cavity distance); h: thickness of insulation film; $\epsilon 1$: dielectric constant of insulation film; and S: area of diaphragm.

Further, since the insulation film 26 has both the thick film-thickness region 28 and the thin film-thickness region 27, electrostatic force is to be calculated for each region using equation (1).

That is, the electrostatic force of the thick film-thickness region 28 is calculated considering the film thickness h as the film thickness of the region 28; and the area of diaphragm S, as the area of the diaphragm corresponding to the region 28 (that is, equivalent to the area of the region 28). The electrostatic force of the thin film-thickness region 27 is calculated likewise by substituting each corresponding value. In addition, since the distance g between the insulation film 26 and the individual electrode 43 varies every moment depending on the displacement of the diaphragm 25, the electrostatic force calculated in equation (1) is only a value at a certain point of time.

According to equation (1), it is obvious that a higher electrostatic force can be obtained in the case of a thinner film-thickness of the insulation film 26, as compared to the case of a thicker film-thickness, and also in the case of a shorter distance between the insulation film 26 and the individual electrode 43.

Now, the displacement of the diaphragm 25 shown in FIG. 5 and FIG. 6 will be reviewed taking the above facts into consideration. In a transition from FIG. 5A to FIG. 5B shown as an early step of displacement of the diaphragm 25, the thick film-thickness region 28 is closer to the individual electrode 43 as compared to the thin film-thickness region 27. Therefore, the electrostatic force generated between the diaphragm region corresponding to the thick film-thickness region 28 and the individual electrode 43 is larger than that on the side of the thin film-thickness region 27, which works effectively for warping the diaphragm 25 in the early step of displacement of the diaphragm 25.

Then, when the warpage of the diaphragm 25 progresses as shown in FIGS. 5B and 5C, and FIGS. 6B and 6C, the thin film-thickness region 27 gets closer to the individual electrode 43, shortening the distance between the region 27 on the insulation film 26 and the individual electrode 43. Furthermore, since the relevant region 27 has a thin film-thickness, the electrostatic force generated between the diaphragm region corresponding to the region 27 and the individual electrode 43 becomes larger as compared to the case without the region 27 (that is, the case where the entire part of the insulation film 26 is uniformly formed with a thickness of the thick film-thickness region 28). The electrostatic force generated in such a situation strongly attracts the diaphragm 25 to the individual electrode 43. Then, such a large electrostatic force with a strong attraction disappears when the fluid is ejected. Therefore, the pressure generated in the pressure-generating chamber 21 can be increased and stabilized ejection characteristics (ejection speed) can be secured.

As described above, according to the first embodiment, it is possible to increase the displacement of the vibration pate 25 by the amount of the space A by providing the thin film-thickness region 27 on the insulation film 26, as compared to the case where the insulation film 26 is formed uniformly with a thickness of the thick film-thickness region 28. Further, since the electrostatic force generated from the start of displacement of the diaphragm 25, followed by contact with the individual electrode 43, and until the restoration of the shape can be increased as a whole, the pressure inside the pressure-generating chamber 21 can be increased. Therefore, stabilized ejection characteristics can be obtained.

In addition, since the thin film-thickness region 27 can be formed at any part within the diaphragm region 29, a small amount of error in alignment of the photoresist film caused in forming the insulation film 26 having the thin film-thickness region 27 is allowable. Therefore, there is no need for dimensional design considering errors, which allows more-dense actuators and relaxes the requirements for fabrication accuracy, leading to easier manufacturing.

Moreover, since the thin film-thickness region 27 is formed at the approximate center of the diaphragm region 29, the diaphragm 25 can be displaced uniformly and the developed pressure inside the entire pressure-generating chamber 21 can be increased uniformly.

In addition, in the first embodiment, although the thin film-thickness region 27 is formed at the approximate center of the diaphragm region 29, the position is not so limited. However, in the widthwise direction of the diaphragm region 29, it is preferable to form the region 27 at the approximate center because if the region 27 is remarkably shifted in the widthwise direction, the shifted part may be dislocated from the position opposite to the individual electrode 43, losing the effectiveness of increasing the displacement of the diaphragm 25. In other words, by forming the thin film-thickness region 27 at the approximate center of the diaphragm region 29, the thin film-thickness region 27 can be surely placed within the region opposite to the individual electrode 43, which prevents the diaphragm 25 from not functioning to increase the amount of displacement when shifted widthwise from the region opposite to the individual electrode 43.

On the other hand, the thin film-thickness region 27 can be positioned closer to the nozzle 31 than the lengthwise center of the diaphragm region 29. With such a configuration, the pressure generated near the nozzle 31 can be increased in the pressure-generating chamber 21, and therefore the droplet ejection speed can be increased. Further, the thin film-thickness region 27 can be positioned farther from the nozzle 31 than the lengthwise center (that is, on the side of the reservoir 22). With such a configuration, the developed pressure on the side of the reservoir 22 in the pressure-generating chamber 21 can be increased, and therefore more fluid can be drawn into the pressure-generating chamber 21 from the reservoir 22. As described above, because the effect varies with the position where the thin-film-thickness 27 is provided, it may be preferable to select the position of the thin film-thickness region 27 according to the desired purpose.

Second Embodiment

Figure 7:
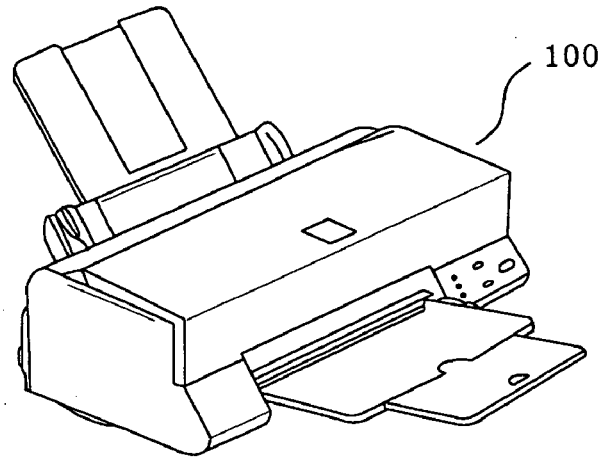
FIG. 7 is a drawing of an exemplary droplet ejection device according to the second embodiment of the present invention.

FIG. 7 is an example drawing of a droplet ejection device according to a second embodiment of the present invention, especially, an example using an inkjet recording device which ejects ink. An inkjet recording device 100 in FIG. 7 is an ink-jet printer which mounts the droplet ejection head 1 having the electrostatic actuator according to the first embodiment. The droplet ejection head 1 having the electrostatic actuator according to the first embodiment has a high developed pressure inside the pressure-generating chamber 21 and can obtain stabilized ejection characteristics, which permits printing with a high resolution. Therefore, in the second embodiment, the inkjet recording device 100 by which printing with a high resolution is stably achieved can be obtained.

Figure 8:
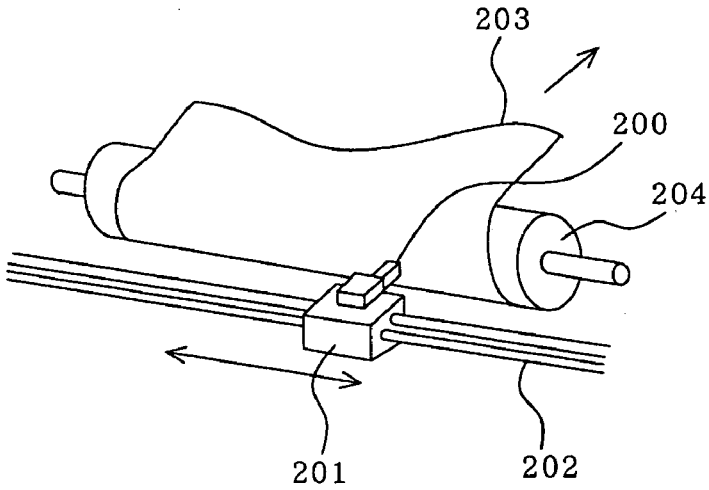
FIG. 8 is a drawing of a printing unit of the ink-jet recording device shown in FIG. 7.

FIG. 8 is a drawing of a printing unit of the ink-jet recording device shown in FIG. 7. An inkjet head 200 is mounted on a carriage 201. The carriage 201 can move laterally along a guide rail 202. A recording paper 203 slides, with the rotation of a roller 204, in the direction perpendicular to the guide rail 202. As ink droplets are ejected from the inkjet head 200 with the lateral movement of the carriage 201 and the rotation of the roller 204, characters and images can be printed.

The droplet ejection head 1 having the electrostatic actuator according to the first embodiment can also be employed in manufacturing of organic electroluminescence display devices, color filters for liquid crystal display devices, etc., other than the inkjet printer shown in FIG. 7.

What is claimed is:

1. An electrostatic actuator comprising:

a first substrate having a diaphragm functioning as a first electrode; and a second substrate coupled to the first substrate and having a second electrode opposite the first electrode, wherein:

the diaphragm is displaced with an electrostatic force generated by applying a voltage between the electrodes; and an insulation film is provided on a coupling surface of the first substrate which couples with the second substrate, and an area of the insulation film corresponding to the diaphragm has a reduced thickness region.

2. The electrostatic actuator according to claim 1, wherein the reduced thickness region is provided at an approximate widthwise center of the area corresponding to the diaphragm.

3. The electrostatic actuator according to claim 2, wherein the reduced thickness region is provided at an approximate lengthwise center of the area corresponding to the diaphragm.

4. The electrostatic actuator according to claim 1, wherein the insulation film comprises one of a $SiO_2$ film and a SiN film.

5. A droplet ejection head comprising:

a first substrate having a diaphragm functioning as a first electrode; and a second substrate coupled to the first substrate and having a second electrode opposite the first electrode, wherein:

the diaphragm is displaced with an electrostatic force generated by applying a voltage between the electrodes which makes droplets eject from a nozzle communicating with a pressure-generating chamber generating a pressure for ejecting the droplets; and an insulation film is provided on a coupling surface of the first substrate which couples with the second substrate, and an area of the insulation film corresponding to the diaphragm has a reduced thickness region.

6. The droplet ejection head according to claim 5, wherein the reduced thickness region is provided at an approximate widthwise center of the area corresponding to the diaphragm.

7. The droplet ejection head according to claim 6, wherein the reduced thickness region is provided at an approximate lengthwise center of the area corresponding to the diaphragm.

8. The droplet ejection head according to claim 5, wherein the reduced thickness region is provided at a position closer to the nozzle than an approximate lengthwise center of the area corresponding to the diaphragm.

9. The droplet ejection head according to claim 5, wherein the reduced thickness region is provided at a position farther from the nozzle than an approximate lengthwise center of the area corresponding to the diaphragm.

10. The droplet ejection head according to claim 5, wherein the insulation film is formed of one of a $SiO_2$ film and a SiN film.

11. A droplet ejection device comprising the droplet ejection head according to claim 5.

* * * * *